US009080411B1

(12) United States Patent
Lugo

(10) Patent No.: US 9,080,411 B1
(45) Date of Patent: Jul. 14, 2015

(54) SUBSEA DIVERTER SYSTEM FOR USE WITH A BLOWOUT PREVENTER

(71) Applicant: Mario R. Lugo, Houston, TX (US)

(72) Inventor: Mario R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 14/152,520

(22) Filed: Jan. 10, 2014

Related U.S. Application Data

(63) Continuation-in-part of application No. 13/269,769, filed on Oct. 10, 2011, now Pat. No. 8,720,580, which is a continuation-in-part of application No. 13/160,032, filed on Jun. 14, 2011.

(51) Int. Cl.

| | |
|---|---|
| ***E21B 33/06*** | (2006.01) |
| ***E21B 33/064*** | (2006.01) |
| ***E21B 34/04*** | (2006.01) |
| *E21B 43/01* | (2006.01) |
| *E21B 33/038* | (2006.01) |

(52) U.S. Cl.
CPC ..... *E21B 33/064* (2013.01); *E21B 34/04* (2013.01); *E21B 33/038* (2013.01); *E21B 43/01* (2013.01)

(58) Field of Classification Search
CPC . E21B 43/01; E21B 33/0355; E21B 43/0122; E21B 33/06; E21B 33/035; E21B 33/038
USPC ..... 166/344, 345, 363, 364, 338, 368
See application file for complete search history.

(56) References Cited

U.S. PATENT DOCUMENTS

| | | | | | |
|---|---|---|---|---|---|
| 2,168,764 | A * | 8/1939 | Day | 277/327 |
| 2,897,895 | A * | 8/1959 | Ortloff | 166/95.1 |
| 4,026,354 | A * | 5/1977 | Burrow | 166/95.1 |
| 4,324,505 | A | 4/1982 | Hammett | |
| 4,405,258 | A | 9/1983 | O'Rourke et al. | |
| 4,444,250 | A | 4/1984 | Keithahn et al. | |
| 4,502,534 | A * | 3/1985 | Roche et al. | 166/84.4 |
| 4,646,844 | A | 3/1987 | Roche et al. | |
| 4,828,024 | A * | 5/1989 | Roche | 166/84.4 |
| 5,323,860 | A | 6/1994 | Watkins | |
| 5,984,012 | A | 11/1999 | Wactor et al. | |
| 6,230,824 | B1 | 5/2001 | Peterman et al. | |
| 7,165,619 | B2 | 1/2007 | Fox et al. | |
| 7,308,954 | B2 | 12/2007 | Martin-Marshall | |
| 7,464,751 | B1 * | 12/2008 | Abel | 166/85.4 |
| 7,597,811 | B2 | 10/2009 | Usher | |
| 7,921,917 | B2 | 4/2011 | Kotrla et al. | |
| 2006/0037782 | A1 | 2/2006 | Martin-Marshall | |
| 2009/0095464 | A1 | 4/2009 | McGrath et al. | |
| 2009/0260829 | A1 | 10/2009 | Mathis | |
| 2012/0018165 | A1 * | 1/2012 | Crossley et al. | 166/344 |
| 2014/0190701 | A1 * | 7/2014 | Humphreys | 166/345 |

* cited by examiner

*Primary Examiner* — James G Sayre
(74) *Attorney, Agent, or Firm* — Egbert Law Offices, PLLC

(57) ABSTRACT

An apparatus for diverting a fluid from a subsea well has a blowout preventer with an upper portion and a lower portion, and a diverter affixed between the upper and lower portions of the blowout preventer. Each of the upper portion and lower portion of the blowout preventer has a flow passageway extending vertically therethrough. The diverter has an interior passageway extending vertically therethrough in alignment with the flow passageway of the upper and lower portions of the blowout preventer. The diverter has a flowline communicating with the interior passageway and extends outwardly therefrom. The flowline has a valve thereon which is movable between an open position and a closed position. The open position is suitable for allowing at least a portion of the fluid from the flow passageway to pass outwardly of the flowline to a location remote from the blowout preventer.

18 Claims, 3 Drawing Sheets

SUBSEA DIVERTER SYSTEM FOR USE WITH A BLOWOUT PREVENTER

CROSS-REFERENCE TO RELATED APPLICATIONS

The present application is a continuation-in-part of U.S. patent application Ser. No. 13/269,769, filed on Oct. 10, 2011, and entitled "System and Method for Diverting the Fluids from a Damaged Blowout Preventer", presently pending. U.S. patent application Ser. No. 13/269,769, was a continuation-in-part of U.S. patent application Ser. No. 13/160,032, filed on Jun. 14, 2011, and entitled "Diverter System for a Subsea Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for diverting the flow of hydrocarbons from a blowout preventer. More particularly, the present invention the relates to systems and methods for diverting the flow of fluid from a subsea well away from the blowout preventer and for release in a remote location.

2. Description of Related Art Including Information Disclosed Under 37 CFR 1.97 and 37 CFR 1.98.

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to a marine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

When high pressures of well fluids are encountered, the excess pressure is diverted as a release into the water. Such hydrocarbon releases are extremely undesirable because of environmental consequences. Additionally, if such pressures are not released, it is possible that such high pressures could eventually cause a further subsea blowout of the subterranean formation at a location away from the well. As such, it is extremely important to be able to effectively release the pressures from the well in order to avoid the possibility of another subterranean blowout.

Whenever the high pressure hydrocarbons are released into the subsea environment. A waste of the hydrocarbons will occur. If a substantial amount of such hydrocarbons are released, then the production of such hydrocarbons is diminished. As a result, it is desirable to recapture such hydrocarbons and to avoid the release of such hydrocarbons into the subsea environments.

In past diversion systems, a variety of components are connected to a capping stack or a diverter system. These components involve the connection of various hoses to the subsea tree, to the subsea mandrel, or to other apparatus in the subsea environment. This is a very complicated and time-consuming procedure. Several ROVs would be required in order to complete such installations. The completion of such installations can be very difficult considering the nature of the blowout. The equipment often needs to be transported from remote locations in order to be effectively installed. As such, it would be desirable to be able to provide a system whereby the equipment necessary for the capping of the damaged blowout preventer is easily available or made available in the location of the blowout.

One of the problems associated with diverter systems for blowout preventers is that, under certain circumstances, the pressure fluid released from the blowout preventer is of extremely high pressures, up to 15,000 p.s.i. When such high pressures are released, it creates a boiling action in the water. The extreme turbulence caused by the release of such pressures can adversely affect the oil drilling and production platform located at the surface above the well. In other circumstances, the extreme boiling of the water in the area adjacent to the offshore platform can effectively prevent the effective use of ships and other marine vessels associated with efforts to repair the damaged blowout preventer and to close the well. In other circumstances, the boiling of the hydrocarbons at the surface of the water can present a great potential for a fire and the destruction of the offshore vessels and/or platform. As such, it is desirable to be able to divert such high pressures to a location away from the blowout preventer so that the boiling action of the hydrocarbons is transferred to a location away from the marine vessels and the offshore platform.

The boiling action caused by the release of high-pressure fluids from the subsea well can further damage the subsea equipment. Such high pressures may adversely affect the ability to connect apparatus to the blowout preventer for repair. In other circumstances, the released hydrocarbons can effectively clog and/or damage valves and other associated equipment for the blowout preventer.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized well bore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

U.S. Pat. No. 6,230,824, issued on May 15, 2001 to Peterman et al., teaches a rotating subsea diverter for isolating fluid in a well from other fluid above the well. The rotating diverter includes a housing body which has a bore running through it. A retrievable spindle assembly includes a spindle and a bearing assembly that is disposed in the bore. The bearing assembly supports the spindle for rotation. The spindle is adapted to receive and seal around a tubular member. The rotation of the tubular member rotates the spindle within the bore.

U.S. Pat. No. 7,308,954, issued on Dec. 18, 2007 to P. S. Martin-Marshall, shows a rotating diverter head for use on a blow out preventer stack of an oil well. The head provides for sealing and rotation of a drill pipe through the head and includes a flange on which the head is rotatable. The flange connects the head to the stack whereupon it can be rotated to align a return flowline before being locked in position.

U.S. Patent Publication No. 2006/0037782, published on Feb. 23, 2006 to P. S. Martin-Marshall, describes a monitoring system for a rotating diverter head for use in an oil well. The system includes a pressure sensor which is mounted beside the stripper rubber which contacts the drill pipe. An increase in the pressure monitored provides early warning of degradation or imminent failure of the seal.

It is an object of the present invention to provide an apparatus for the containment of the flow of fluids resulting from a damaged or defective blowout preventer.

It is another object of the present invention to provide a system that is attachable to a blowout preventer so as to contain the flow of fluids in the event of a blowout.

It is another object of the present invention to provide a system which effectively diverts the flow of high-pressure fluids to a location remote from the blowout preventer.

It is another object of the present invention to provide a system which avoids the boiling of fluids at the surface of the body of water in an area adjacent to the offshore platform.

It is still further object of the present invention to automatically divert fluids in the event of a difference of pressures between the upper portion of the blowout preventer and the lower portion of the blowout preventer.

It is still further object of the present invention to provide a system that can be easily secured within existing blowout preventers.

These and other objects and advantages of the present invention will become apparent from a reading of the attached specification and appended claims.

BRIEF SUMMARY OF THE INVENTION

The present invention is an apparatus for diverting a fluid from the subsea well. This apparatus comprises a blowout preventer having an upper portion of the lower portion, and a diverter affixed between the upper portion and the lower portion of the blowout preventer. Each of the upper portion and the lower portion of the blowout preventer has a flow passageway extending vertically therethrough. The blowout preventer has a valve in the upper portion and a valve in the lower portion. The valve is suitable for closing a flow of the fluid through the flow passageway. The diverter has an interior passageway that extends vertically therethrough in alignment with the flow passageway of the upper and lower portions of the blowout preventer. The diverter has a flowline communicating with the interior passageway and extends outwardly therefrom. The flowline has a valve thereon. The valve of the flowline is movable between an open position at a closed position. The open position is suitable for allowing at least a portion of the fluid from the flow passageway to pass outwardly of the flowline. The closed position is suitable for blocking the fluid from passing outwardly of the flowline of the diverter.

In the apparatus of the present invention, a pipe is connected to the flowline of the diverter. This pipe extends away from the blowout preventer so as to have an end positioned remotely from the blowout preventer. In particular, the pipe can include a jumper affixed to an outlet of the flowline and a casing connected to an end of the jumper opposite the outlet of the flowline. The casing will have a fluid vent at an end opposite the jumper.

The flowline of the diverter includes a first flowline communicating with the interior passageway of the diverter and a second flowline communicating with the interior passageway of the diverter. Each of the first and second flowlines has the valve therein. The first flowline is positioned on an opposite side of the diverter from the second flowline.

A first pressure transducer is cooperative at the flow passageway in the upper portion of the blowout preventer. A second pressure transducer is cooperative with the flow passageway of the lower portion of the blowout preventer. Each of the first and second pressure transducers is suitable for measuring a pressure in the flow passageway. The first and second pressure transducers are controllably interconnected to the valve of the flowline of the diverter so as to move the valve of the flowline to the open position when the first pressure transducer senses that a pressure in the fluid flow passageway of the upper portion of the blowout preventer is less than a pressure sensed by the second pressure transducer in the flow passageway of the lower portion of the blowout preventer.

The valve of the flowline of the diverter is a gate valve. This gate valve has an actuator extending outwardly therefrom. The actuator is suitable for manipulation by a remotely-operated vehicle (ROV). The flowline of the diverter has a connector at an end thereof. The diversion line has a connector thereon. The connector of the diversion line is engageable with the connector of the diverter. The diverter has a first panel on one side of the connector thereof and a second panel on an opposite side of the connector thereof. The connector of the diversion line is movable between the first and second panel so as to engage with the connector of the flowline. The diversion line has a first pipe section and a second pipe section. The first pipe section is longitudinally aligned with the flowline. The second pipe section communicates within in an interior of the first pipe section. The second pipe section extends radially outwardly of the first pipe section. The first pipe section has an actuator at an end thereof opposite the connector thereof. The actuator is suitable for opening or closing a valve within the first pipe section such that fluid can flow outwardly through the second pipe section.

The diverter includes a diverter block of an annular configuration. An upper end of the diverter block is affixed in sealing relation to a lower end of the upper portion of the blowout preventer. A lower end of the diverter block is affixed in sealing relation to an upper end of the lower portion of the blowout preventer.

The present invention is also a method for diverting a fluid from a subsea well. This method includes the steps of: (1) affixing a diverter between an upper portion and a lower portion of a blowout preventer; (2) affixing the lower portion of the blowout preventer to a wellhead; (3) actuating a valve in the flowline of the diverter so as to move the valve from a closed position to an open position; and (4) flowing the fluid from the subsea well through the flowline of the diverter to a location remote from the blowout preventer.

The method of the present invention further includes the steps of affixing a pipe to an end of the flowline opposite the diverter, flowing the fluid from the flowline through the pipe, and releasing the fluid from an end of the pipe opposite the flowline. Also, in the present invention, fluid pressure is sensed in the upper portion of the blowout preventer and the fluid pressure is sensed in the lower portion of the blowout preventer. The valve is moved from the closed position to the open position when the sensed fluid pressure in the upper portion of the blowout preventer is less than the sensed fluid pressure in the lower portion of the blowout preventer.

So as to further effect the diversion of fluids from the subsea well, the valve in the upper portion of the blowout preventer is closed. A diversion line can be guided to a connector at an end of the flowline. The connector of the diversion line is engaged with the connector of the flowline. A valve is opened in the diversion line so as to allow fluid to flow outwardly of the flowline.

The pipe includes a jumper and a casing. The jumper is affixed to an end of the flowline such that the jumper extends downwardly to a subsea floor adjacent the wellhead of the subsea well. The casing is affixed to an end of the jumper opposite the flowline such that the casing extends along the surface of the subsea floor.

This foregoing Section is intended to describe, with particularity, the preferred embodiment of the present invention. It is understood that modifications to this preferred embodiment can be made within the scope of the present invention. As such, the section should not be construed, in any way, as limiting of the broad scope of the present invention. The present invention should only be limited by the following claims and their legal equivalents.

DETAILED DESCRIPTION OF THE INVENTION

Figure 1:
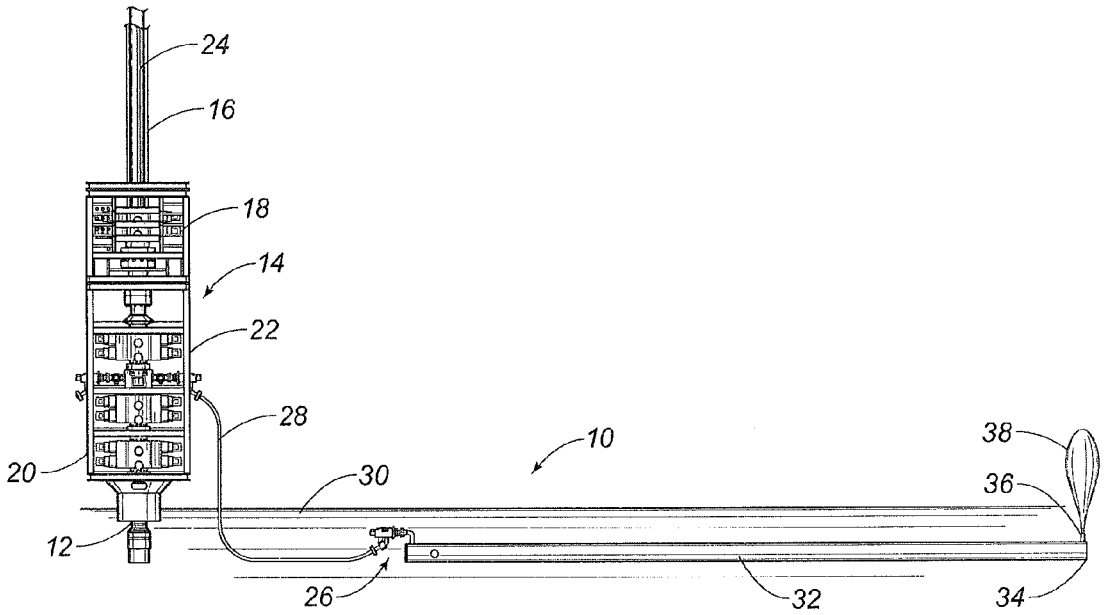
FIG. 1 is a side elevational view illustrating the system for diverting fluids from the subsea well in accordance of the present invention.

Referring to FIG. 1, there shown the system 10 for the diversion of fluids from a subsea well. In FIG. 1, it can be can be seen that there is a wellhead 12 that is associated with a subsea well. A blowout preventer 14 is positioned on the wellhead 12 and extends vertically upwardly therefrom. A lower marine riser package 16 can be affixed to the upper end the blowout preventer 14. The blowout preventer 14 has an upper portion 18 and the lower portion 20. Importantly, in the present invention, there is a diverter 22 that is positioned between the upper portion 18 in the lower portion 20 of the blowout preventer 14.

In the present invention, and as will be described hereinafter, the blowout preventer 14 will have a flow passageway extending vertically therethrough. The diverter 12 will have an interior passageway that extends vertically therethrough. This interior passageway of the diverter 22 will be aligned with the flow passageways of the upper portion 18 and the lower portion 20 of the blowout preventer 14. As such, in normal operations, fluids will flow through the wellhead 12, through the flow passageway of the lower portion 20, through the interior passageway of the diverter 22, through the flow passageway of the upper portion 18, and outwardly through the tubing string 24. As such, production can occur in a conventional manner.

In FIG. 1, it can be seen that there is a pipe 26 that has one and connected to the diverter 22. In particular, the pipe 26 includes a jumper 28 which is affixed at one and to the diverter 22 and extends downwardly therefrom so as to be directed toward the floor 30 of the body of water. A casing 32 is connected to the jumper 28 and extends so as to have an end 34 located remotely from the blowout preventer 14. Suitable connections are provided between the jumper 28 and the casing 32 so as to allow installation subsea through the use of an ROV.

Importantly, in FIG. 1, it can be seen that a problem with the blowout preventer 14 has occurred. Under such a circumstance, the valve in the upper portion 18 of the blowout preventer 14 can be closed and the valve associated with the diverter 22 is open to such that fluids from the well will flow outwardly of the blowout preventer 14 through the diverter 22. These fluids will flow through the pipe 26 so as to be released from a vent 36 located at the end 34 of the casing 32 away from the blowout preventer 14.

In this configuration, it can be seen that the plume 38 will be released away from the blowout preventer 14. As such, the present invention is able to avoid those problems associated with the boiling of the high-pressure hydrocarbons from the well at the surface of the body of water adjacent to the production platform and/or marine vessels. As such, repairs to the blowout preventer 14 and the subsea structures can occur without the hazards created by the high-pressure release of hydrocarbons in the area of the blowout preventer 14. Since the plume 38 is released a significant distance away from the blowout preventer 14, any risk of fire from the released hydrocarbons at the surface of the body of water will occur a significant distance away from the production platform. As such, the present invention is effectively able to divert the flow of fluids from the well to a remote location. Ultimately, various types of fluid capture equipment can be positioned adjacent to the vent 36 of the casing 32 so as to capture hydrocarbons as released from the vent.

Figure 2:
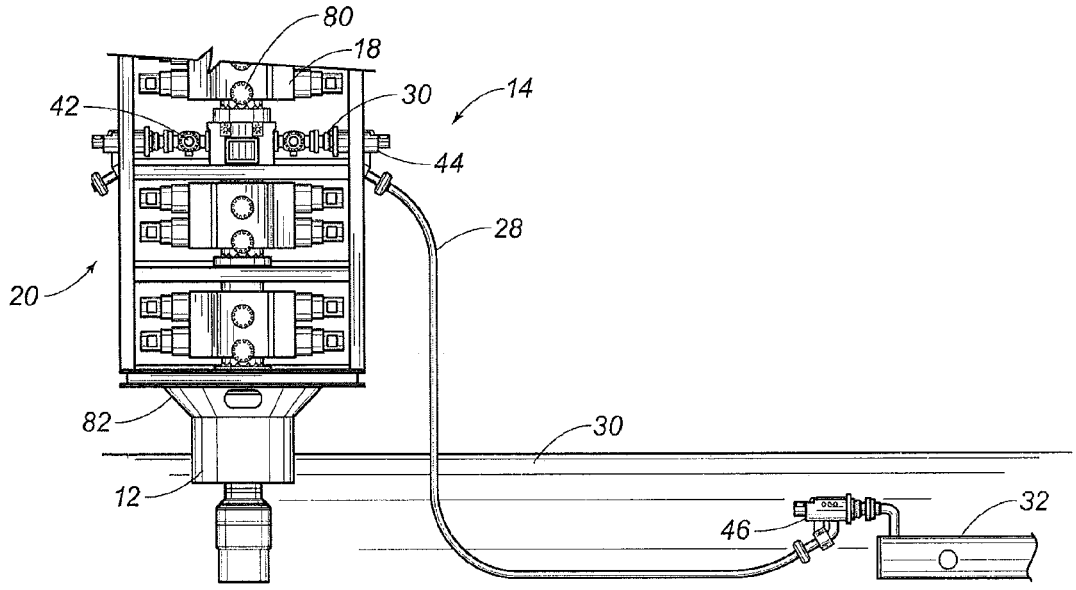
FIG. 2 is a side elevational view showing the connection between the pipe and the diverter.

FIG. 2 is a illustration of the connections associated with the blowout preventer 14. In FIG. 2, can be seen that the upper portion 18 of the blowout preventer 14 has a lower end that is connected to the diverter 22. The lower portion 20 of the blowout preventer 14 has an upper end that is connected to the diverter 22. The diverter 22 is illustrated as having a first flowline 40 extending outwardly therefrom. A second flowline 42 is also connected to the diverter 22 and extends outwardly therefrom. Each of the flowlines 40 and 42 will communicate with the interior passageway of the diverter 22. Suitable valves are provided on the flowlines 40 and 42 so as to control the flow of the fluid through the flowlines 40 and 42.

In FIG. 2, it can be seen that there is a diversion line 44 that is connected to an end of the first flowline 40. The diversion line 44 can be installed by an ROV in the subsea location. Importantly, the jumper 28 has one end connected to a pipe section of the diversion line 44. The jumper 28 extends downwardly toward the subsea floor 30. Ultimately, the jumper 28 is suitably flexible enough so as to conform to the contour of the subsea floor 30. A connector arrangement 46 is located at the end of the jumper 28. This connector arrangement 46 is suitable for connecting with the casing 32. In this configuration, it can be seen that the valve associated with the flowline 40 can be open so as to allow any fluids flowing through the interior passageway of the diverter 22 can flow outwardly therefrom and into the jumper 28 and casing 32. In order to facilitate this flow of the fluid, one of the valves associated with the upper portion 18 of the blowout preventer 14 will be closed so that the fluids are effectively diverted through the flowline 40.

It should be noted that the lower portion 20 of the blowout preventer 14 includes several valves, rams and shear devices. Ultimately, if there is a problem with the blowout preventer 14 or with the wellhead 12, the valves associated with the lower portion 20 can be closed so as to attempt to contain the flow of fluid. However, if there should be a failure of the lower portion 20 of the blowout preventer 14, then the upper portion 18 can be operated so as to cause the diversion of fluid through the diverter 22. As such, the present invention provides significant redundancy in the protection against the release of hydrocarbons.

Figure 3:
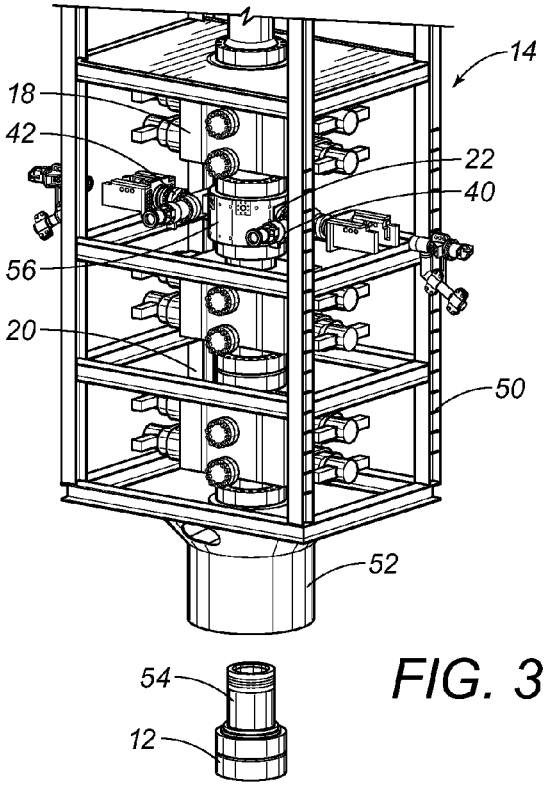
FIG. 3 is a perspective view showing the configuration of the blowout preventer and diverter in accordance with the present invention.

FIG. 3 illustrates the blowout preventer 14 as used in the present invention. The blowout preventer 12 includes a frame 50 that extends around the upper portion 18 and the lower portion 20 of the blowout preventer 14. The blowout preventer 14 includes a connector 52 at a lower end thereof. Connector 52 includes conventional mechanism so as to facilitate connection with the mandrel 54 associated with the wellhead 12. As such, the flow passageway of the blowout preventer 14 will be in fluid communication with the flow passageway of the wellhead 12.

In FIG. 3, the connector section 22 is illustrated as affixed in sealing relationship between the upper portion 18 in the lower portion 20 of the blowout preventer 14. The diverter 22 has the first flowline 40 extending outwardly on one side of the diverter block 56 and the second flowline 42 extending outwardly of the other side of the diverter block 56. The diverter block 56 is of an annular configuration.

Figure 4:
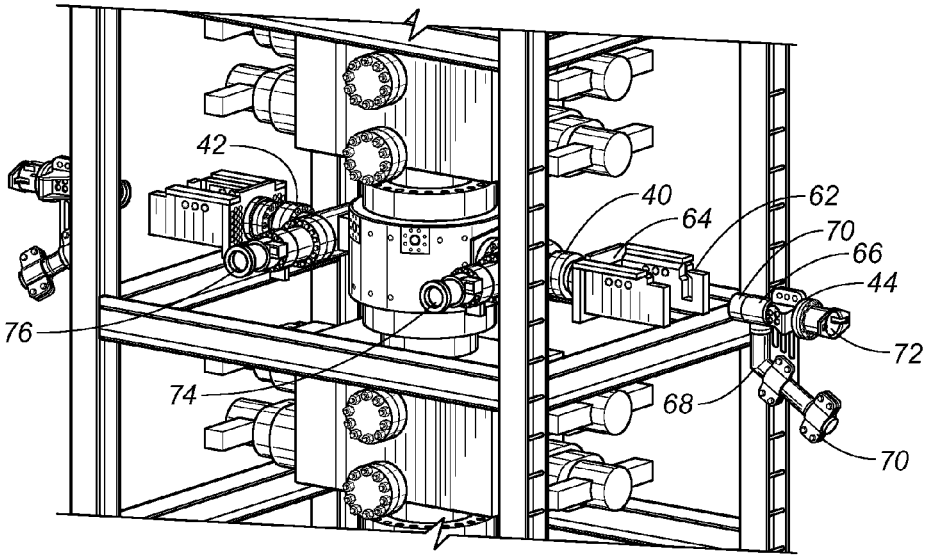
FIG. 4 is a perspective view showing the connections between the pipe and the diverter.

FIG. 4 illustrates, in detail, the manner in which the diversion line 44 can be secured to the flowline 40. In FIG. 4, the flowline 40 has a connector at an end thereof. A first panel 60 and a second panel 62 extend on opposite sides of the connector 64 of the flowline 40. The panels serve as guides for the diversion line 44. As such, and ROV can guide the diversion line 44 toward the connector 64 by way of a sliding action between the panels. As such, a positive connection can be achieved.

The diversion line 44 includes a first pipe section 66 and a second pipe section 68. The first pipe section 66 will be in longitudinal alignment with the flowline 40. The second pipe section 68 will extend radially outwardly of the first pipe section 66 and is in fluid communication with an interior thereof. A connector 70 is positioned at the end of the second pipe section 66 away from the first pipe section 68 opposite the first pipe section 66. An actuator 72 is provided at the end of the first pipe section 66 so as to allow for manipulation by the ROV. As such, a suitable locking action between the connector 70 of the diversion line 44 and the connector 64 of the flowline 40 can be established. This also allows fluid communication between the flowline 40 and the second pipe section 66. The connector 70 can be suitably connected to a connector associated with the jumper 28.

It can be seen that the second flowline 42 has a similar configuration as that of the first flowline 42. As such, if it is necessary to connect another pipe to the second flowline 42, the connection can be carried out in the same manner as with the first flowline 40.

In FIG. 4, it can be seen that there is an actuator 74 that is cooperative with the first flowline 40. Another actuator 76 is cooperative with the second flowline 42. Actuators 74 and 76 are suitable for allowing the valves associated with the flowlines 40 and 42 to be opened.

Importantly, with reference to FIG. 2, it can be seen that there is a first pressure transducer 80 that is positioned in the upper portion 18 of the blowout preventer 14 and a second pressure transducer 82 associated with the lower portion 20 of the blowout preventer 14. The pressure transducers 80 and 82 are intended to sense a pressure within the flow passageways of the upper portion 18 and the lower portion 20. The transducers 80 and 82 can be cooperative with the valves associated with the flowlines 40 and 42 so as to automatically open or and/or close the flowlines 40 and 42. For example, if the pressure sensed by the first pressure transducer 80 in the upper portion 18 is lower than the pressure sensed by the pressure transducer 82 in the lower portion 20, there is an indication of damage to the blowout preventer 14 or of a change in flow characteristics. As such, a signal can be generated so as to automatically open at least one of the flowlines 40 and 42 so that fluid can be diverted therefrom. As such, this automatically avoids the possibility of a blowout condition. For example, if the pressure of fluid in the flow passageway of the lower portion 20 was extremely high to the extent that it could not flow through the flow passageway of the upper portion 18, then potential damage to the blowout preventer 14 could occur. By opening the valves associated with the flowlines 40 and 42, pressure is relieved by being able to divert the pressure through the pipe 26. As such, this excess pressure can be released at a location away from the blowout preventer.

Figure 5:
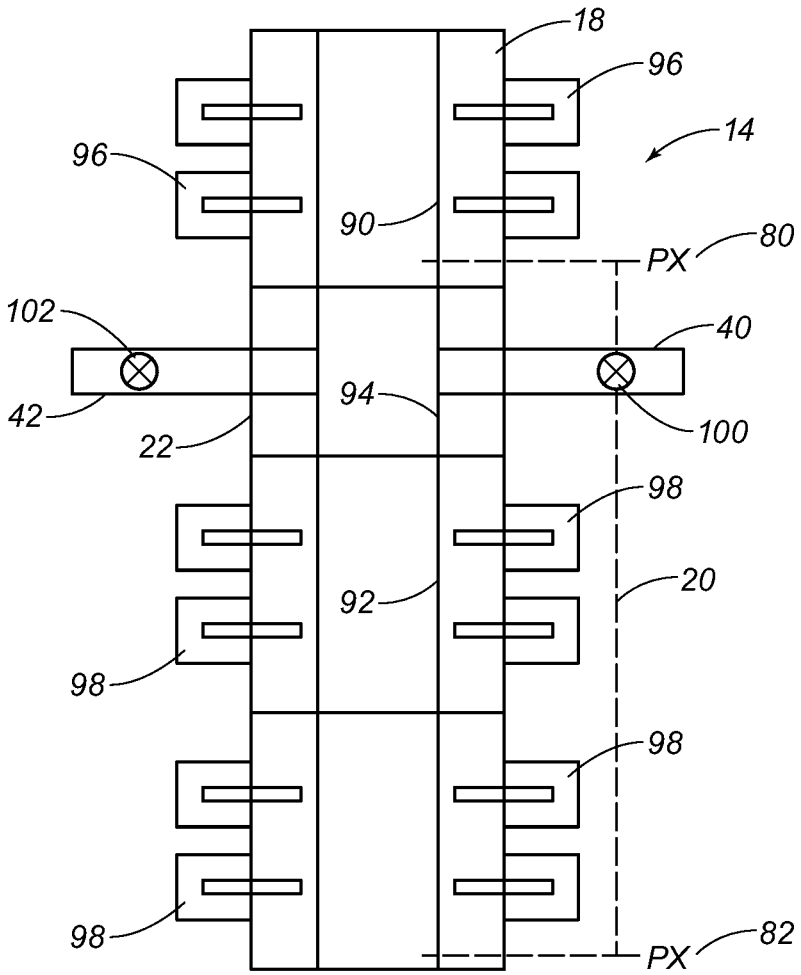
FIG. 5 is a diagrammatic illustration of the construction of the blowout preventer and diverter in accordance with the preferred embodiment of the present invention.

FIG. 5 is a diagrammatic illustration of the blowout preventer 14. The blowout preventer 14 has the upper portion 18 and the lower portion 20 that are particularly illustrated. The diverter 22 is positioned between the upper portion 18 and the lower portion 20. It can be seen that the flow passageway 90 within the interior of the upper portion 18 extends vertically therethrough. Similarly, the flow passageway 92 in the lower portion 20 extends vertically therethrough. The flow passageways 90 and 92 are longitudinally aligned with each other. The diverter 22 has an interior passageway 94 that extends vertically and is longitudinally aligned with the flow passageway 90 and the flow passageway 92. The upper portion of the blowout preventer 14 includes a plurality of rams and/or valves 96. Similarly, the lower portion 20 of the blowout preventer 14 includes a plurality of valves 98 arranged thereon. Once again, these valves 98 can be in the nature of pipe rams, blind rams, shear rams and blind shear rams.

The diverter 22 includes a first flowline 40 and a second flowline 42. Each of the flowlines 40 and 42 has an end that communicates with the interior passageway 94 of the diverter 22. A valve 100 is positioned within the flowline 40. A valve 102 is positioned in the flowline 42. The valves 100 and 102 can be opened or closed. In the open position, fluid will flow from the interior passageway 94 through the flowline. As such, a diversion a fluid can occur. When the valves 100 and 102 are closed, then fluid is prevented from exiting the diverter 22.

In FIG. 5, it can be seen that there is a first pressure transducer 80 that is cooperative with the interior passageway 90 of the upper portion 18. Another pressure transducer 82 is illustrated as cooperative with the lower end of the passageway 92 of the lower portion 20 of the blowout preventer 14. The pressure transducers 80 and 82 are illustrated as cooperative with valve 100. As such, if the pressure transducer 80 should sense that the fluid pressure within the passageway 90 is significantly less than the pressure sensed by these pressure sensor 82, then a signal can be sensed so as to automatically open the valve 100 so that the fluids from the interior passageway 94 are diverted from within the blowout preventer 14. As such, the present invention facilitates the automatic reduction in fluid pressures under certain circumstances.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An apparatus for diverting a fluid from a subsea well, the apparatus comprising:

a blowout preventer having an upper portion and a lower portion, each of said upper portion and said lower portion having a flow passageway extending vertically therethrough, said blowout preventer having a valve in said upper portion and a valve in said lower portion, said valve suitable for closing a flow of the fluid through that flow passageway;

a diverter affixed between said upper portion and said lower portion of said blowout preventer, said diverter having an interior passageway extending vertically therethrough in alignment with said flow passageways of said upper and lower portions of said blowout preventer, said diverter having a flowline communicating with said interior passageway and extending outwardly therefrom, said flowline having a valve thereon, said valve of said flowline movable between an open position and a closed position, said open position suitable for allowing at least a portion of the fluid from the flow passageway to pass outwardly of said flowline, said closed position suitable for blocking the fluid from passing outwardly of said flowline of said diverter; and a first pressure transducer cooperative with said flow passageway of said upper portion of said blowout preventer, and a second pressure transducer cooperative with said flow passageway of said lower portion of said blowout preventer, each of said first and second pressure transducers suitable for measuring a pressure in the flow passageway.

2. The apparatus of claim 1, further comprising:

a pipe connected to said flowline of said diverter, said pipe extending away from said blowout preventer so as to have an end position remotely from said blowout preventer.

3. The apparatus of claim 2, said pipe comprising:

a jumper affixed to an outlet of said flowline; and a casing connected to an end of said jumper opposite said outlet of said flowline.

4. The apparatus of claim 3, said casing having a fluid vent at an end opposite said jumper.

5. The apparatus of claim 1, said flowline of said diverter comprising:

a first flowline communicating with said interior passageway; and a second flowline communicating with said interior passageway, each of said first and second flowlines having a valve therein.

6. The apparatus of claim 5, said first flowline positioned on an opposite side of said diverter from said second flowline.

7. The apparatus of claim 1, said first and second pressure transducers controllably interconnected to said valve of said flowline of said diverter are so as to move said valve of said flowline to said open position when said first pressure transducer senses that a pressure in the flow passageway of said upper portion is less than a pressure sensed by said second pressure transducer in said flow passageway of said lower portion.

8. The apparatus of claim 1, said diverter comprising:

a diverter block of an annular configuration, an upper end of said diverter block affixed in sealing relation to a lower end of said upper portion of said blowout preventer, a lower end of said diverter block affixed in sealing relation to an upper end of said lower portion of said blowout preventer.

9. An apparatus for diverting a fluid from a subsea well, the apparatus comprising:

a blowout preventer having an upper portion and a lower portion, each of said upper portion and said lower portion having a flow passageway extending vertically therethrough, said blowout preventer having a valve in said upper portion and a valve in said lower portion, said valve suitable for closing a flow of the fluid through said flow passageway; and a diverter affixed between said upper portion and said lower portion of said blowout preventer, said diverter having an interior passageway extending vertically therethrough in alignment with said flow passageways of said upper and lower portions of said blowout preventer, said diverter having a flowline communicating with said interior passageway and extending outwardly therefrom, said flowline having a valve thereon, said valve of said flowline movable between an open position and a closed position, said open position suitable for allowing at least a portion of the fluid from the flow passageway to pass outwardly of said flowline, said closed position suitable for blocking the fluid from passing outwardly of said flowline of said diverter, said valve in said flowline of said diverter being a gate valve, said gate valve having an actuator extending outwardly therefrom, said actuator suitable for manipulation by a remotely-operated vehicle.

10. An apparatus for diverting a fluid from a subsea well, the apparatus comprising:

a blowout preventer having an upper portion and a lower portion, each of said upper portion and said lower portion having a flow passageway extending vertically therethrough, said blowout preventer having a valve in said upper portion and a valve in said lower portion, said valve suitable for closing a flow of the fluid through said flow passageway, a diverter affixed between said upper portion and said lower portion of said blowout preventer, said diverter having an interior passageway extending vertically therethrough in alignment with said flow passageways of said upper and lower portions of said blowout preventer, said diverter having a flowline communicating with said interior passageway and extending outwardly therefrom, said flowline having a valve thereon, said valve of said flowline movable between an open position and a closed position, said open position suitable for allowing at least a portion of the fluid from the flow passageway to pass outwardly of said flowline, said closed position suitable for blocking the fluid from passing outwardly of said flowline of said diverter, said flowline of said diverter having a connector at an end thereof; and a diversion line having a connector thereon, said connector of said diversion line engageable with said connector of said diverter.

11. The apparatus of claim 10, said diverter having a first panel on one side of said connector thereof and a second panel on an opposite side of said connector thereof, said connector of said diversion line movable between said first and second panels so as to engage with said connector of said flowline.

12. The apparatus of claim 10, said diversion line having a first pipe section and a second pipe section, said first pipe section being longitudinally aligned with said flowline, said second pipe section communicating with an interior of said first pipe section, said second pipe section extending radially outwardly of said first pipe section.

13. The apparatus of claim 12, said first pipe section having an actuator at an end thereof opposite said connector thereof, said actuator suitable for opening or closing a valve within said first pipe section such that the fluid can flow outwardly through said second pipe section.

14. A method for diverting a fluid from a subsea well, the method comprising:

affixing a diverter between an upper portion and a lower portion of a blowout preventer, said diverter having a flowline extending outwardly therefrom, said flowline communicating with an interior passageway of said diverter, said interior passageway of said diverter being aligned with a flow passageway of said upper and lower portions of said blowout preventer;

affixing said lower portion of said blowout preventer to a wellhead;

actuating a valve in said flowline of said diverter so as to move said valve from a closed position to an open position;

flowing the fluid from the subsea well through said flowline of said diverter to a location remote from said blowout preventer;

affixing a pipe to an end of said flowline opposite said diverter, said pipe extending away from said blowout preventer;

flowing the fluid from said flowline through said pipe; and releasing the fluid from an end of said pipe opposite said flowline.

15. The method of claim 14, further comprising:

closing a valve in said upper portion of said blowout preventer.

16. The method of claim 14, said pipe comprising a jumper and a casing, the method further comprising:

affixing said jumper to an end of said flowline such that said jumper extends downwardly to a subsea floor adjacent the wellhead of a wellhead of the subsea well; and affixing said casing to an end of said jumper opposite said flowline such that said casing extends along a surface of the subsea floor.

17. A method for diverting a fluid from a subsea well, the method comprising:

affixing a diverter between an upper portion and a lower portion of a blowout preventer, said diverter having a flowline extending outwardly therefrom, said flowline communicating with an interior passageway of said diverter, said interior passageway of said diverter being aligned with a flow passageway of said upper and lower portions of said blowout preventer;

affixing said lower portion of said blowout preventer to a wellhead;

actuating a valve in said flowline of said diverter so as to move said valve from a closed position to an open position;

flowing the fluid from the subsea well through said flowline of said diverter to a location remote from said blowout preventer;

sensing a fluid pressure in said upper portion of said blowout preventer; and sensing a fluid pressure in said lower portion of said blowout preventer, the step of actuating comprising:

moving said valve from said closed position to said open position when the sensed fluid pressure in said upper portion of said blowout preventer is less than the sensed fluid pressure in said lower portion.

18. A method for diverting a fluid from a subsea well, the method comprising:

affixing a diverter between an upper portion and a lower portion of a blowout preventer, said diverter having a flowline extending outwardly therefrom, said flowline communicating with an interior passageway of said diverter, said interior passageway of said diverter being aligned with a flow passageway of said upper and lower portions of said blowout preventer;

affixing said lower portion of said blowout preventer to a wellhead;

actuating a valve in said flowline of said diverter so as to move said valve from a closed position to an open position;

flowing the fluid from the subsea well through said flowline of said diverter to a location remote from said blowout preventer;

guiding a diversion line toward a connector at an end of said flowline;

engaging a connector of said diversion line with said connector of said flowline; and opening a valve in said diversion line so as to allow fluid to flow outwardly of said flowline.

* * * * *